US009773460B2

(12) United States Patent
Verbeure et al.

(10) Patent No.: US 9,773,460 B2
(45) Date of Patent: Sep. 26, 2017

(54) SYSTEM, METHOD, AND COMPUTER PROGRAM PRODUCT FOR COMBINING LOW MOTION BLUR AND VARIABLE REFRESH RATE IN A DISPLAY

(71) Applicant: NVIDIA Corporation, Santa Clara, CA (US)

(72) Inventors: Tom Verbeure, Sunnyvale, CA (US); Gerrit A. Slavenburg, Fremont, CA (US); Thomas F. Fox, Santa Clara, CA (US); Robert Jan Schutten, San Jose, CA (US); Luis Mariano Lucas, San Jose, CA (US); Marcel Dominicus Janssens, Sunnyvale, CA (US)

(73) Assignee: NVIDIA Corporation, Santa Clara, CA (US)

( * ) Notice: Subject to any disclaimer, the term of this patent is extended or adjusted under 35 U.S.C. 154(b) by 929 days.

(21) Appl. No.: 14/058,142

(22) Filed: Oct. 18, 2013

(65) Prior Publication Data

US 2015/0109286 A1 Apr. 23, 2015

(51) Int. Cl.
*G09G 3/36* (2006.01)
*G09G 3/34* (2006.01)

(52) U.S. Cl.
CPC ..... *G09G 3/36* (2013.01); *G09G 3/3406* (2013.01); *G09G 2310/0237* (2013.01); *G09G 2320/0257* (2013.01); *G09G 2320/0261* (2013.01)

(58) Field of Classification Search
None
See application file for complete search history.

(56) References Cited

U.S. PATENT DOCUMENTS

2009/0243995 A1* 10/2009 Kimura ..... G09G 3/342 345/102
2009/0327777 A1* 12/2009 Vasquez ..... G09G 3/3611 713/320
2011/0157151 A1* 6/2011 Winer ..... G09G 3/3406 345/214
2013/0063469 A1* 3/2013 Ruckmongathan .... G09G 3/342 345/589

OTHER PUBLICATIONS

U.S. Appl. No. 14/024,550, filed Sep. 11, 2013.
U.S. Appl. No. 13/828,355, filed Mar. 14, 2013.
U.S. Appl. No. 13/830,847, filed Mar. 14, 2013.

* cited by examiner

*Primary Examiner* — Amare Mengistu
*Assistant Examiner* — Sarvesh J Nadkarni
(74) *Attorney, Agent, or Firm* — Zilka-Kotab, PC

(57) ABSTRACT

A system, method, and computer program product are provided for combining low motion blur and variable refresh rate in a display. In one embodiment, a hold-type display is operated in a first mode of operation where the hold-type display is dynamically refreshed such that the hold type display handles updates to image frames at unpredictable times and where for each of the image frames a backlight of the hold-type display is activated for an entire duration of display of the image frame. Additionally, it is determined that at least one predefined condition has been met. Further, in response to the determination, the hold-type display is operated in a second mode of operation where the hold-type display is statically refreshed such that the hold-type display handles updates to image frames at regular intervals and where for each of the image frames the backlight of the hold-type display is flashed.

15 Claims, 15 Drawing Sheets

SYSTEM, METHOD, AND COMPUTER PROGRAM PRODUCT FOR COMBINING LOW MOTION BLUR AND VARIABLE REFRESH RATE IN A DISPLAY

FIELD OF THE INVENTION

The present invention relates to display systems, and more particularly to motion blur in display systems.

BACKGROUND

Motion blur in display systems generally involves the visible blurring of an object in an image moving over a sequence of image frames. The blurring is typically a result of the sequential image frames capturing the movement of the object via incremental changes in the position of the object on the display, where the incremental changes are separated to the extent that they do not necessarily capture the true (fluid, smooth, etc.) path of the moving object. There is thus a need for at least reducing motion blur in display systems. Of course, other issues associated with the prior art may also be addressed.

SUMMARY

A system, method, and computer program product are provided for combining low motion blur and variable refresh rate in a display. In one embodiment, a hold-type display is operated in a first mode of operation where the hold-type display is dynamically refreshed such that the hold type display handles updates to image frames at unpredictable times and where for each of the image frames a backlight (or, more generally, the illuminating light) of the hold-type display is activated for an entire duration of display of the image frame. Additionally, it is determined that at least one predefined condition has been met. Further, in response to the determination, the hold-type display is operated in a second mode of operation where the hold-type display is statically refreshed such that the hold-type display handles updates to image frames at regular intervals and where for each of the image frames the backlight of the hold-type display is flashed. Additionally, it is determined that at least one predefined condition has been met. Further, in response to the determination, the display changes from the second mode of operation back to the first mode of operation.

In another embodiment, an impulse-type display or an impulse-like display is operated in a first mode of operation where the display is statically refreshed such that the display handles updates to image frames at fixed times. Additionally, it is determined that at least one first predefined condition has been met. In response to the determination that the at least one first predefined condition has been met, the display is operated in a second mode of operation where the display is dynamically refreshed such that the display handles updates to image frames at irregular intervals and where for each of the image frames an illumination is a function of a known or predicted refresh time period for that image frame. Further, it is determined that at least one second predefined condition has been met. In response to the determination that the at least one second predefined condition has been met, operation of the display is returned from the second mode of operation to the first mode of operation.

In yet another embodiment, a hold-type display is operated in a first mode of operation where the hold-type display is dynamically refreshed such that the hold type display handles updates to image frames at unpredictable times and where for each of the image frames a backlight (or, more generally, the illuminating light) of the hold-type display is activated for an entire duration of display of the image frame. Additionally, it is determined that at least one predefined condition has been met. Further, in response to the determination, the hold-type display is operated in a second mode of operation where the hold-type display is dynamically refreshed and where for each of the image frames the backlight of the hold-type display is flashed. Additionally, it is determined that at least one predefined condition has been met. Further, in response to the determination, the display changes from the second mode of operation back to the first mode of operation.

DETAILED DESCRIPTION

A system, method, and computer program product are provided for combining low motion blur and variable refresh rate in a display. In the context of the present description, the variable refresh rate refers to the device being capable of handling updates to image frames at unpredictable times. Further, the low motion blur refers to any reduction of motion blur (i.e. blurring of an object moving across image frames) otherwise at least potentially made apparent by the display. The low motion blur may be achieved by flashing a backlight of the display, as described below. While a backlight is described with reference to the embodiments, herein, it should be noted that any desired light source used for illuminating a panel of a display device or a screen (e.g., used with a projector) displaying image frames may be similarly controlled.

As described below, the low motion blur and variable refresh rate may be combined in various ways. In one embodiment described with respect to FIG. 1, a hold-type display operating with a variable refresh rate and constant backlight may transition to operating with a fixed refresh rate and a flashing backlight to provide the low motion blur. In another embodiment, described with respect to FIG. 2, an impulse-type or impulse-like display operating with a fixed refresh rate may transition to operating with a variable refresh rate and a variable illumination. In yet another embodiment, described with respect to FIG. 3, a hold-type display operating with a variable refresh rate and constant backlight may transition to operating with the variable refresh rate and a flashing backlight to provide the low motion blur (impulse type display).

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 1:
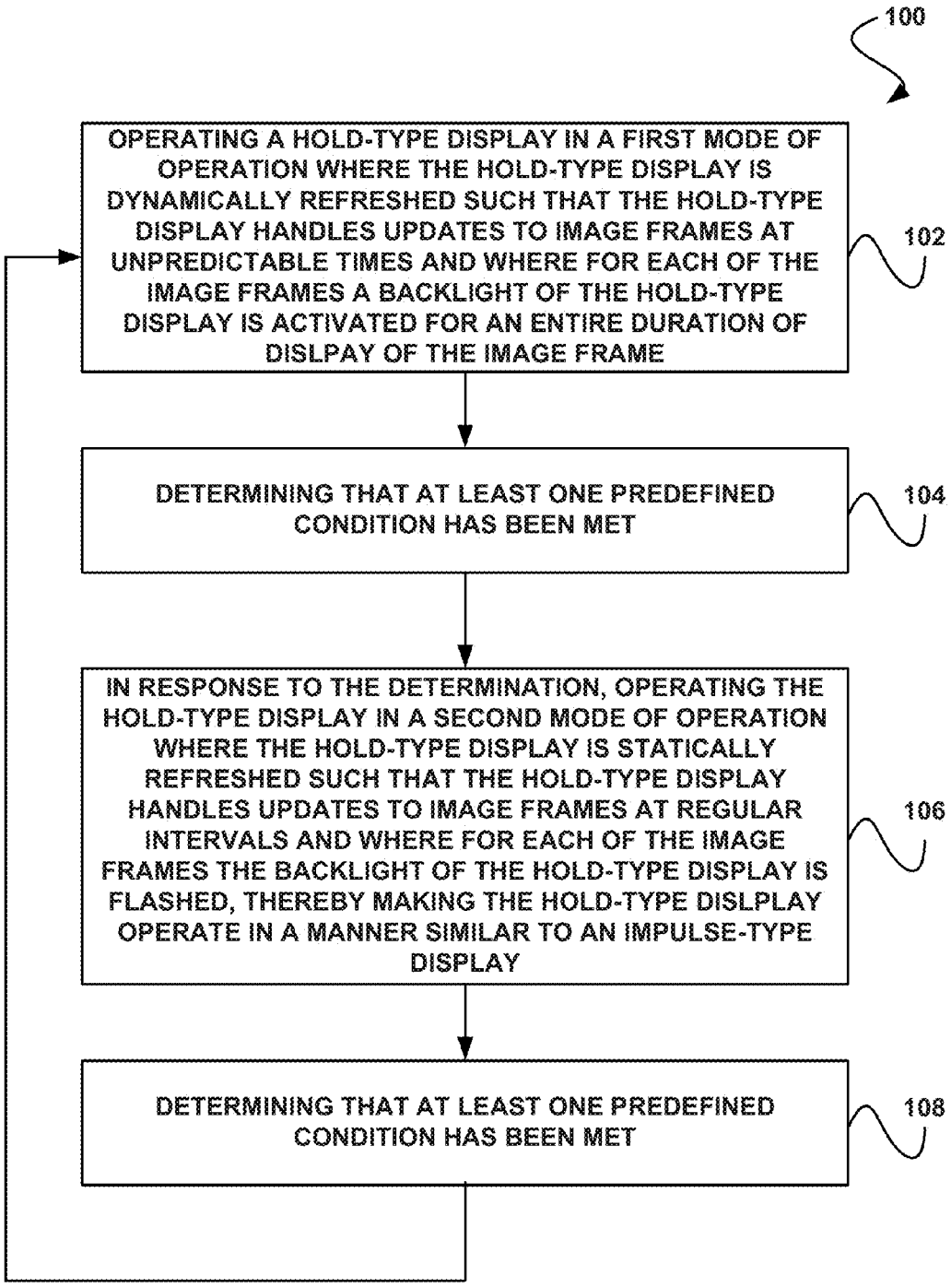
FIG. 1 shows a method for transitioning from operating a hold-type display in a first mode of operation including a variable refresh rate and constant backlight to operating the hold-type display in a second mode of operation including a fixed refresh rate and a flashing backlight, in accordance with one embodiment. Additionally, it is determined that at least one predefined condition has been met. Further, in response to the determination, the display changes from the second mode of operation back to the first mode of operation.

FIG. 1 shows a method 100 for transitioning from operating a hold-type display in a first mode of operation including a variable refresh rate and constant backlight to operating the hold-type display in a second mode of operation including a fixed refresh rate and a flashing backlight, in accordance with one embodiment. As shown in operation 102, a hold-type display is operated in a first mode of operation where the hold-type display is dynamically refreshed such that the hold type display handles updates to image frames at unpredictable times and where for each of the image frames a backlight of the hold-type display is activated for an entire duration of display of the image frame.

With respect to the present description, the hold-type display includes any display device where illumination of the panel is held, such as a liquid crystal display (LCD). Traditionally, a constant illumination per image frame is provided by these hold-type displays.

As noted above, in operation 102 the hold-type display is operated in a first mode of operation. The first mode of operation includes a variable refresh rate, where the hold-type display is dynamically refreshed such that the hold type display handles updates to image frames at unpredictable times. In particular, the dynamic refreshing may be provided based on two factors, including 1) the display being in a state where an entirety (e.g. all lines, pixels, etc.) of an image frame is currently displayed by the display, and 2) a determination of whether all of a next image frame to be displayed by the display has been rendered to memory and is thus ready to be displayed by the display. When an entirety of an image frame is currently displayed by the display and a next image frame to be displayed (i.e. immediately subsequent to the currently displayed image frame) has been rendered in its entirety to memory, such next image frame may be transmitted to the display for display thereof. This results in a variable refresh since the refresh does not necessarily occur at regular intervals but instead occurs based on the current state of the display and the readiness of the next image frame for display.

More information regarding a display operating with a variable refresh rate are provided in U.S. patent application Ser. No. 13/830,847, filed Mar. 13, 2013, by Slavenburg et al. and entitled "SYSTEM, METHOD, AND COMPUTER PROGRAM PRODUCT FOR MODIFYING A PIXEL VALUE AS A FUNCTION OF A DISPLAY DURATION ESTIMATE," as well as in U.S. patent application Ser. No. 14/024,550, filed Sep. 11, 2013, by Petersen et al. and entitled "SYSTEM, METHOD, AND COMPUTER PROGRAM PRODUCT FOR PROVIDING A DYNAMIC DISPLAY REFRESH," both of which are incorporated herein by reference in their entirety.

As also noted above, in the first mode of operation in which the hold-type display operates in operation 102, a backlight of the hold-type display is activated, for each of the image frames, for an entire duration of display of the image frame. Thus, a constant illumination is provided by the backlight for each of the image frames, during the first mode of operation. Of course, it should be noted that a small delay in activating the backlight after display of each image frame may be implemented.

Additionally, as shown in operation 104, it is determined that at least one predefined condition has been met. At least in the context of the present embodiment, the predefined condition may be any condition that has been previously configured (e.g. on-the-fly just prior to the determination, or preconfigured prior to initiation of the method 100) to allow the hold-type display to effectively reduce motion blur without impacting display quality when operating in the second impulse-like mode of operation described below.

In one embodiment, the predefined condition may be a predefined refresh rate (e.g. 85 Hz) of the hold-type display. In such embodiment, determining that the at least one predefined condition has been met may be based on a determination that the hold-type display is operating at or above the predefined refresh rate, or will be operating at or above the predefined refresh rate for a next image frame (based on using an image frame duration prediction described below). Optionally, temporal hysteresis may be utilized with respect to the predefined threshold rate for determining whether the at least one predefined condition has been met. In particular, it may only be determined that the at least one predefined condition has been met when the hold-type display has been operating at or above the predefined refresh rate for at least preconfigured amount of time. Thus, in cases where the refresh rate alternates between a refresh rate that is above/below the predefined refresh rate, temporal hysteresis may be utilized to prevent continuously switching between the first mode of operation and the second mode of operation.

Further, as shown in operation 106, in response to the determination that the predefined condition(s) has been met, the hold-type display is operated in a second mode of operation where the hold-type display is statically refreshed such that the hold-type display handles updates to image frames at regular intervals and where for each of the image frames the backlight of the hold-type display is flashed. Thus, in the second mode of operation, the hold-type display may operate without the variable refresh rate, but instead in a traditional manner where image frames are updated at regular intervals.

Also in the second mode of operation, the backlight of the hold-type display is flashed for each of the image frames, instead of being activated for an entire duration of the display of the image frame as in the first mode of operation. It should be noted that the flashing of the backlight may involve any activation of the backlight only for a duration of time that is less than the entire duration of display of the image frame. It may be desired to provide a consistent level of light output (per unit time when averaged over the frame time) by the backlight, to avoid visible variations in brightness across the image frames. Accordingly, as an option, the flashing of the backlight may involve activating the backlight for a same consistent) duration of time and at a constant intensity for each of the image frames. For example, since the refresh rate is regular, and thus identifiable, the backlight may be flashed for a constant duration and at a constant intensity for each of the image frames, where such combination of duration/intensity is determined to provide a steady and desired level of light output for the image frames when averaged over the frame time Further to the consistent level of light output by the flashing of the backlight, it should be noted that the backlight may be flashed at any point in time after the display of the image frame by the display. For example, the backlight may be flashed in response to a last pixel of the image frame being painted on the display (i.e. an entirety of the image frame being displayed by the display), or a predetermined amount of time after the beginning of the display of the entirety of the image frame by the display. The predetermined amount of time may be preconfigured to allow the pixels of the image frame time to settle to their desired value, as an option. As another option, the predetermined amount of time may be set to allow for an amount of time until the next image frame is received, as determined based on the static refresh rate.

By operating the hold-type display in the second mode of operation, reduced motion blur (hereinafter also referred to as low motion blur) may be provided by displaying the image frame on the hold-type display while the back-light is disabled, waiting until the pixels of the image frame settle to their desired value, and then flashing the backlight for a particular duration and at a particular intensity that results in a desired level of light being output to illuminate the image frame. It should be noted that the particular duration and the particular intensity at which the backlight is flashed may be shorter and higher, respectively, than when operating in the first mode of operation in order to provide a same level of light when averaged over the refresh time otherwise output by the backlight during the first mode of operation.

As further shown in operation 108 returning back to operation 102, as soon as the predefined condition is no longer met (e.g. the refresh rate drops back below the predefined refresh rate) or any other predefined condition is met (operation 108), the hold-type display may be switched back to operating in the first mode of operation (operation 102). This may avoid the aforementioned unwanted impact on display quality resulting from otherwise operating the hold-type display in the second (impulse-like) mode of operation under improper conditions (i.e. when the predefined condition(s) is not met). Just by way of example, flicker may be visible in a situation where the hold-type display is operated in the second mode of operation (with the flashing backlight) at a refresh rate that is less than the predefined refresh rate.

Figure 2:
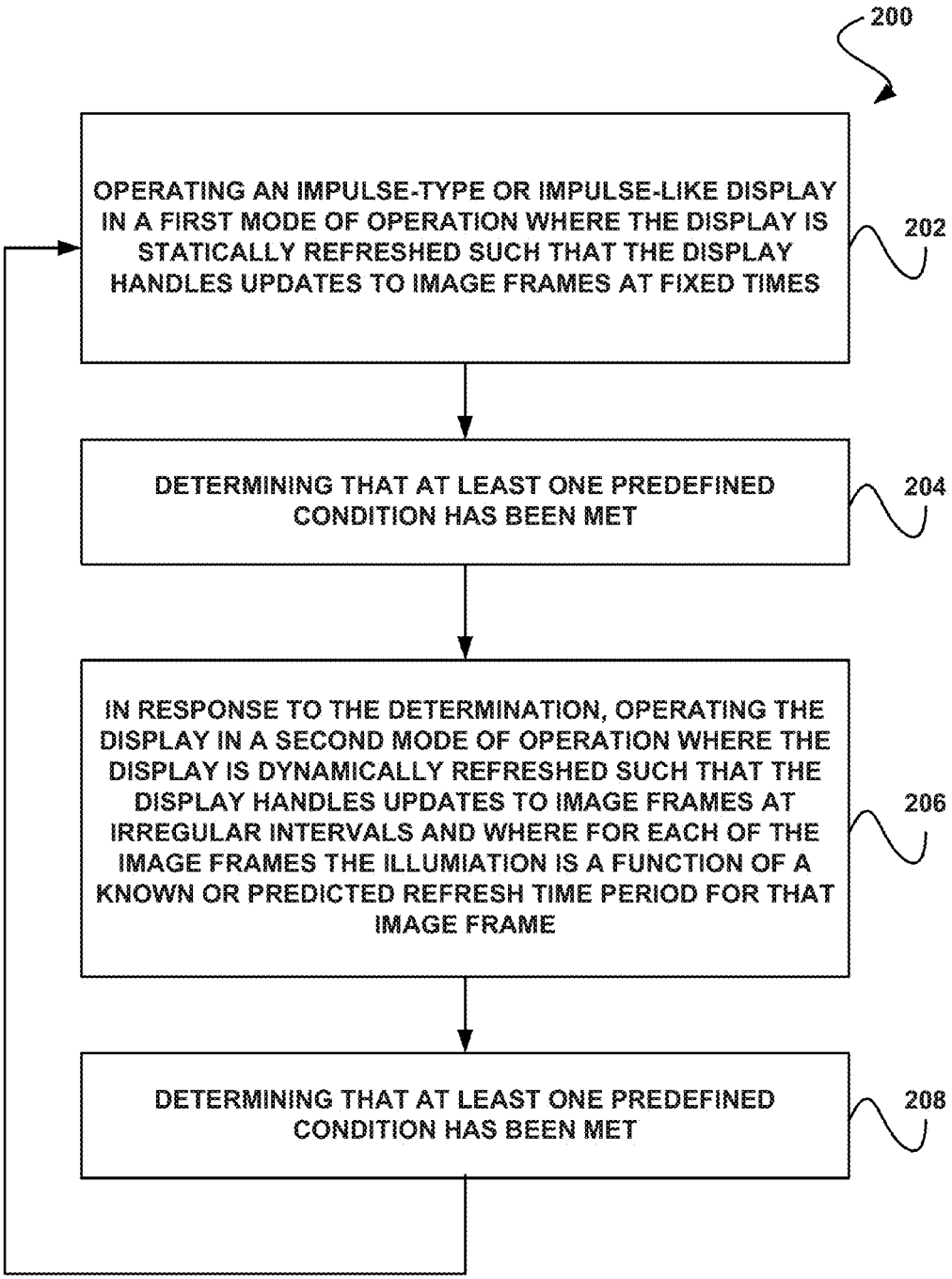
FIG. 2 shows a method for transitioning from operating an impulse or impulse-like display in a first mode of operation including fixed refresh rate to operating the display in a second mode of operation including a variable refresh rate and variable illumination. Additionally, it is determined that at least one predefined condition has been met. Further, in response to the determination, the display changes from the second mode of operation back to the first mode of operation.

FIG. 2 shows a method 200 for transitioning from operating an impulse or impulse-like display in a first mode of operation including fixed refresh rate to operating the display in a second mode of operation including a variable refresh rate and variable illumination. In operation 202, an impulse-type display or an impulse-like display is operated in a first mode of operation where the display is statically refreshed such that the display handles updates to image frames at fixed times (i.e. regular intervals). It should be noted that at least in the context of the present embodiment, the impulse-like display may be a hold-type display operated in an impulse-like manner (e.g. with a flashing light source) or an impulse-type display such as a cathode-ray tube (CRT), projector, etc.

Additionally, as shown in operation 204, it is determined that at least one first predefined condition has been met. As shown in operation 206, in response to the determination that the at least one first predefined condition has been met, the display is operated in a second mode of operation where the display is dynamically refreshed such that the display handles updates to image frames at irregular intervals (i.e. unpredictable times) and where for each of the image frames an illumination is a function of a known or predicted refresh time period for that image frame. The illumination may be provided by the display or separate from the display, but in any case may be used to illuminate the image frames for viewing by a user.

As described below with reference to FIG. 2 (see "Optional Variation"), images may be repeated in such a fashion that the refresh rate of the display always stays above a predefined minimal refresh rate such that no flicker will be perceived.

As noted above, the display is operated in the second mode of operation with a variable refresh rate. Thus, in the present embodiment, a consistent desired level of light being output by the illumination for all of the image frames may be achieved using a predetermination of the duration of time that the image frame will be displayed. The duration of time that is predetermined may be an actual (known) or estimated (predicted) duration of time that the image frame will be displayed.

Table 1 illustrates one algorithm for obtaining a consistent desired level of light across image frames displayed with varying duration. Of course, it should be noted that Table 1 is set forth for illustrative purposes only and should not be construed as limiting in any manner.

TABLE 1

| |
|---|
| total illumination output/frame duration = desired level of light, where total illumination output = illumination intensity * active duration (flash) of illumination, where frame duration = the predetermined duration of the image frame, and where desired level of light = a constant for all image frames |

As an option, where an actual duration of time that the image frame will be displayed is unknown, an estimated duration of time that the image frame will be displayed may be determined. It should be noted that the duration of time that the image frame will be displayed may be estimated in any desired manner. In one embodiment, the estimated duration of time may be determined as a duration of time in which a preceding image frame was displayed. In another embodiment, the estimated duration of time may be determined based on a pattern in durations of time during which a predetermined number of preceding image frames were displayed. In yet another embodiment, the estimated duration of time may be determined based on a duration of time in which a preceding image frame was displayed in combination with information received from a processor (e.g. CPU, CPU, etc.) rendering the image frame, the information indicating for each rendering operation performed by the processor, any difference between a time taken to perform the operation when rendering the image frame and a time taken to perform the operation when rendering the preceding image frame. In yet another embodiment, the estimated duration of time (to the end of the frame is determined by the CPU/GPU by analyzing the nature of the image (e.g., its complexity and thus the amount of time required to generate it) that is being rendered before the rendering is complete, and using the information to control the intensity and duration of the illumination.

It should be noted that the processor and the display may be in communication via any desired means (e.g. for allowing the display to receive the information from the processor). For example, the processor and display can communicate through a side band signal such as the auxiliary data channel of a DisplayPort or the DDC/CI interface of a DVI or HDMI interface, through an in-band signal such a special packet on the video data interface.

More information regarding at least the aforementioned various examples of estimating the duration of time that the image frame will be displayed will be described in more detail below.

As another option, an actual duration of time that the image frame will be displayed may be determined. In one embodiment, the actual duration of time may be determined by delaying display of the image frame until an entirety of a next image frame to be displayed is received from a processor rendering the next image frame, and then determining the actual duration of time as a period between receipt of the image from the processor and receipt of the next image frame from the processor. More information regarding at least this example of determining the actual duration of time that the image frame will be displayed will be described in more detail below.

Further to the dynamic duration of the illumination, it should be noted that the illumination may be activated at any point in time after the display of the image frame by the display. For example, the illumination may be activated in response to a last pixel of the image frame being painted on the display (i.e. an entirety of the image frame being displayed by the display), or a predetermined amount of time after the beginning of the display of the image frame by the display, to allow the pixels of the image frame time to settle to their desired value.

Operating the display with both the variable refresh and low motion blur may involve various other techniques described with reference to the subsequent figures below. These techniques may ensure that the illumination is activated at the correct time, and with the correct intensity, and may ensure smooth transitions back and forth between operation of the display without low motion blur and operation of the display with the low motion blur. For micromirror type displays, the duration of reflection for each pixel of a frame is a function of the desired average light output for that pixel. When the refresh rate is variable, the methods described can be used to modify the duration and/or intensity of reflection (or illumination) to achieve the correct light out for each pixel, averaged over the refresh time of the frame.

As further shown in operation 208 returning back to operation 202, as soon as the predefined condition is no longer met or any other predefined condition is met (operation 208), the display may be switched back to operating in the first mode of operation (operation 202). This may avoid an unwanted impact on display quality resulting from otherwise operating the display in the second mode of operation under improper conditions.

Optional Variation

In another variation, impulse or impulse-like displays may be operated in yet another first mode of operation. Referring to 202 of FIG. 2, the display can be refreshed dynamically (i.e., variable refresh rate) rather than statically (i.e., fixed refresh rate), whilst avoiding flicker at low frame rates, by selectively repeating an incoming frame multiple times (based on the predicted frame duration) to ensure that refresh is above the flicker perception threshold (i.e. predefined refresh rate). The illumination for the image frames is a function of a known or predicted refresh time period for that image. In this manner impulse-type or impulse-like displays can be dynamically refreshed in both the first mode and the second mode.

Figure 3:
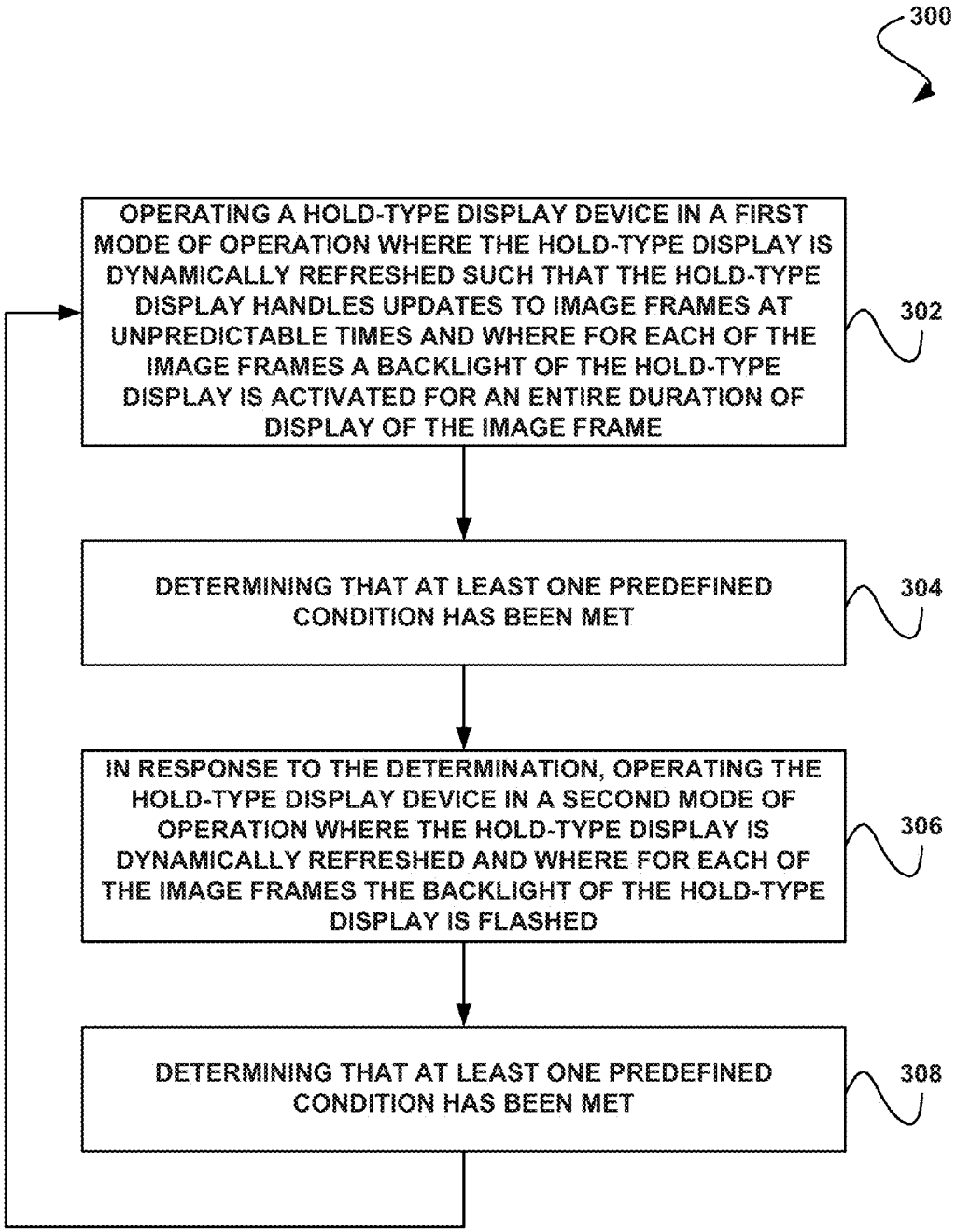
FIG. 3 shows a method for operating a hold-type display in a first mode of operation including a variable refresh rate and constant backlight to operating the hold-type display in a second mode of operation including the variable refresh rate and a flashing backlight thereby making it operate as an impulse-like display, in accordance with yet another embodiment. Additionally, it is determined that at least one predefined condition has been met. Further, in response to the determination, the display changes from the second mode of operation back to the first mode of operation.

FIG. 3 shows a method 300 for operating a hold-type display in a first mode of operation including a variable refresh rate and constant backlight to operating the hold-type display in a second mode of operation including the variable refresh rate and a flashing backlight, in accordance with yet another embodiment (i.e., an impulse-like display).

As shown in operation 302, a hold-type display is operated in a first mode of operation where the hold-type display is dynamically refreshed such that the hold type display handles updates to image frames at unpredictable times and where for each of the image frames a backlight of the hold-type display is activated for an entire duration of display of the image frame.

Additionally, as shown in operation 304, it is determined that at least one predefined condition has been met. In one embodiment, the predefined condition may be a predefined refresh rate (e.g. 85 Hz) of the hold-type display. In such embodiment, determining that the at least one predefined condition has been met may be based on a determination that the hold-type display is operating at or above the predefined refresh rate. Optionally, as described above with reference to FIG. 1, temporal hysteresis may be utilized with respect to the predefined threshold rate for determining whether the at least one predefined condition has been met.

In another embodiment, the predefined condition may be a determination that fewer than a threshold number of image frames or frame pairs previously displayed in sequence differed in duration by less than a threshold amount. As described below, the second mode of operation may only be capable of effectively reducing motion blur when either an actual duration of time in which an image frame is to be displayed is known, or when an estimated duration of time in which an image frame is to be displayed is accurate, or accurate enough for the intended purpose. In the case where the estimated duration of time is utilized, it may be determined that such estimations will be sufficiently accurate (e.g. predictable), and thus the predefined condition met, when no more than a threshold number of previously displayed image frame pairs (taken in sequence) differed by less than a threshold amount. Further examples of this predefined condition will be described below with reference to FIGS. 10A-B.

In yet another embodiment, the predefined condition may be a determination that an application generating the image frames (e.g. a game, etc.) is either whitelisted or not blacklisted. In particular, the predefined condition may be met when the application is included in a whitelist of applications predetermined to be suitable with operation of the hold-type display in the second mode of operation, or when the application is not included in a blacklist of applications predetermined to not be suitable with operation of the hold-type display in the second mode of operation.

Further, as shown in operation 306, in response to the determination that the predefined condition(s) has been met, the hold-type display is operated in a second mode of operation where the hold-type display is dynamically refreshed and where for each of the image frames the backlight of the hold-type display is flashed.

Thus, in the second mode of operation, the backlight of the hold-type display is flashed for each of the image frames, instead of being activated for an entire duration of the display of the image frame as in the first mode of operation. It should be noted that the flashing of the backlight involve any activation of the backlight only for a duration of time that is less than the entire duration of display of the image frame. As an option, the flashing of the backlight may involve activating the backlight for a same duration and at a same intensity, such that the flashing may not necessarily be dynamic.

As another option, the flashing of the backlight may be dynamic. For example, for each of the image frames, the backlight of the hold-type display may be flashed for a duration of time and a level of intensity which in combination produces a same desired level of light output by the backlight for all of the image frames. In this way, the desired level of light may be constant across the image frames displayed during operation of the hold-type display in the second mode of operation. Examples of achieving this desired level of light is described above with reference to FIG. 2.

Further to the flashing of the backlight, it should be noted that the backlight may be flashed at any point in time after the display of the image frame by the hold-type display. For example, the backlight may be flashed in response to a last pixel of the image frame being painted on the display (i.e. an entirety of the image frame being displayed by the display), or a predetermined amount of time after the beginning of the display of the entirety of the image frame by the display. The predetermined amount of time may be preconfigured to allow the pixels of the image frame time to settle to their desired value, as an option. As another option, the predetermined amount of time may be set as a time until the next image frame is received. In the situation where the next image frame is not received when expected, or within the threshold refresh rate time noted by the predefined condition described above, the backlight may be flashed at the threshold refresh rate time, and further may be held until the next image frame is received.

As further shown in operation 308 returning back to operation 302, as soon as the predefined condition is no longer met (e.g. the refresh rate drops back below the predefined refresh rate) or any other predefined condition is met (operation 308), the hold-type display may be switched back to operating in the first mode of operation (operation 302). This may avoid the aforementioned unwanted impact on display quality resulting from otherwise operating the hold-type display in the second (impulse-like) mode of operation under improper conditions (i.e. when the predefined condition(s) is not met). Just by way of example, flicker may be visible in a situation where the hold-type display is operated in the second mode of operation (with the flashing backlight) at a refresh rate that is less than the predefined refresh rate.

Figure 4:
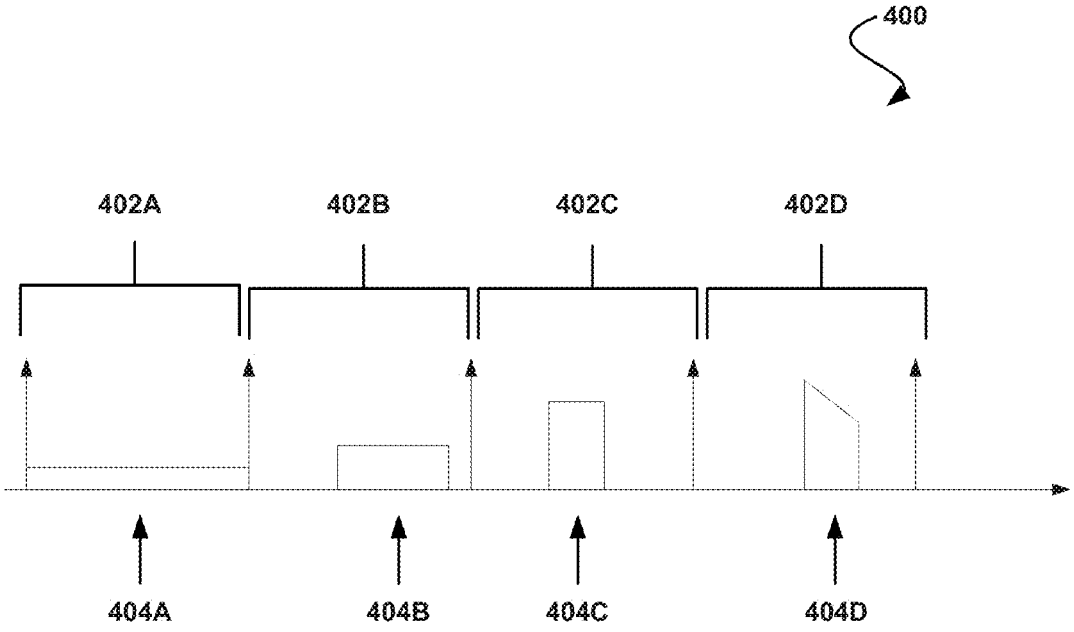
FIG. 4 shows a timing diagram with various shapes of backlight activation across multiple image frames each having a constant level of light output when averaged over the frame time, in accordance with one embodiment.

Refresh Rate Dependent Backlight Flashing and Intensity to Maintain Constant Average Light Intensity FIG. 4 shows a timing diagram 400 with various shapes of backlight activation across multiple image frames each having a constant level of light output, in accordance with one embodiment. Generally, low motion blur is achieved by flashing (i.e. activating, enabling, etc.) the backlight only for a short duration after a current image has been sent to a panel of a display device. Further description of low motion blur is described in U.S. patent application Ser. No. 13/828,355, filed Mar. 14, 2013, and entitled "Low Motion Blur Liquid Crystal Display," which is incorporated herein by reference in its entirety.

However, it may be desirable that the amount of light that is output by the backlight remains constant. A constant desired amount of light may be achieved by modulation of both a duration of time in which the backlight is activated and an intensity at which the backlight is activated.

The present timing diagram 400 illustrates a fixed refresh rate display system, where the receipt of a new frame by the display system is marked with the upward arrow. Thus, 402A-D each designate a different image frame displayed by the display device, and particularly a duration of display of the different image frames. The shapes 404A-D in between the designated image frame 402A-D signify both the active period (in the x-direction) and the level of intensity (in the y-direction) of the backlight. This timing diagram 400 shows how a constant per-frame average intensity can be obtained for a fixed refresh rate (i.e. where the distance between the up arrows is the same). The first image frame 402A does not use a flashing backlight, while the next three image frames 402B-D do use a flashing backlight.

Even though the duration and the intensity of the backlight are different for each of the image frames 402A-D, the level of light output per image frame (as visualized by the area of each shape) is identical. Both the amount of light per image frame time and the absolute amount of light per image frame time that is output by the backlight is identical since the refresh rate is constant.

Figure 5:
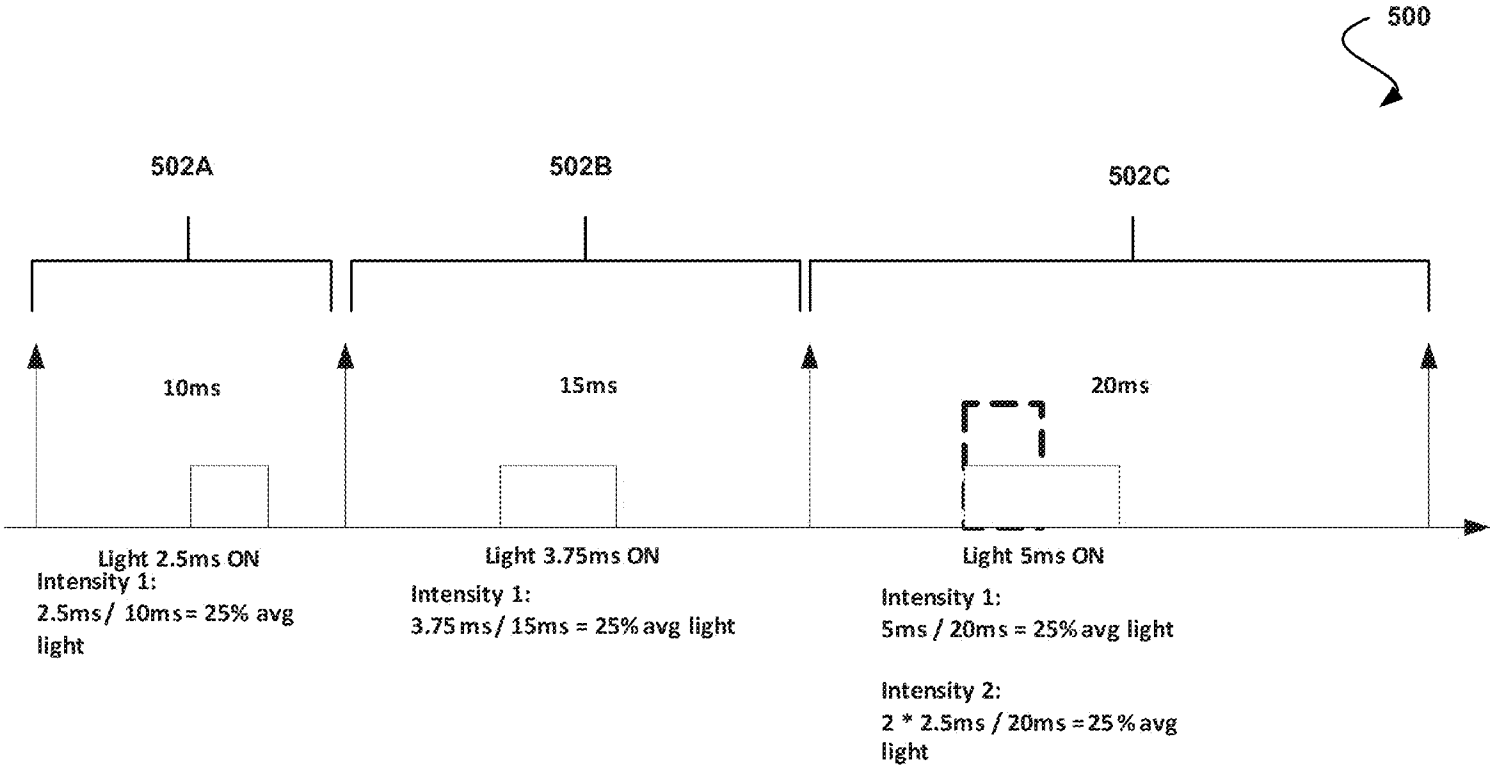
FIG. 5 shows a timing diagram of a hold-type display operating in a second mode of operation including a variable refresh rate and a dynamically flashing backlight, in accordance with one embodiment.

FIG. 5 shows a timing diagram 500 of a hold-type display operating in a second mode of operation including a variable refresh rate and a dynamically flashing backlight, in accordance with one embodiment. As shown, the receipt of a new frame by the display system is marked with the upward arrow. Thus, 502A-C each designate a different image frame displayed by the display device, and particularly a duration of display of the different image frames.

For a display system with a variable refresh rate and a flashing backlight, the amount of light per image frame may still be desired to be constant, but the absolute amount of light for each image frame may be variable, since it is dependent on the duration of display of the image frame. As shown, the absolute amount of light transmitted is different for each of the three image frames 502A-C, but when divided by the duration of the image frame 502A-C, the average amount of light output by the backlight is constant. In the second frame 502B, only the duration of the flash of the backlight is extended from the duration shown for image frame 502A. For the third frame 502C, two cases are shown, one where the duration of the flash of the backlight is extended from the duration shown for image frame 502A, and another one where the duration is the same as the duration shown for image frame 502A, but the intensity has been doubled from the intensity shown for image frame 502A.

Image Frame Duration Prediction

In some circumstances, it is not known beforehand when a next image frame will be received by the display system for display thereof, yet in a variable refresh rate display system this information may be desired to determine the duration and intensity for which the backlight should be flashed.

For example, for a fixed rate low motion blur display mode, the backlight of the display is switched on a fixed time after the bottom row of pixels of the display have been painted, and it is switched back off again a fixed time later, typically around the time when the top row of pixels of the panel will be repainted. Of course, this is only an example provided with reference to a display that scans from top to bottom, and it should be noted that in other configurations the display may scan bottom to top, left to right or right to left, such that the backlight may be switched on a fixed time after the last pixel of the display has been painted and then switched off a fixed time later (e.g. around the time when a first pixel of the display is painted for a next image frame).

However, for a variable refresh rate low motion blur display mode, the backlight of the display should be switched on at the same time as for a fixed rate panel (some time after the bottom row has been painted), hut the time after which the backlight is switched off may depend on the arrival time of the next incoming image frame.

For a backlight with fixed intensity, the backlight may be switched on such that, for each frame of variable length, the percentage of the frame length during which the backlight is active, is constant. Just by way of example, if the time between the start of 2 frames is 8 ms, and it take 5 ms to paint the frame, the backlight may be switched on for 2 ms, or 25% of the total frame length. If this time from one frame to the next increases to 40 ms, then the backlight may be switched on for 10 ms.

There are various techniques that may be used to predetermine the (estimated or actual) duration of an image frame, or in other words a time of receipt of the image frame for display until a time of receipt of a next image frame for display. The following illustrate some examples.

Using the Previous Frame Time Interval

One way to predict the duration of display of an image frame is to keep track of the time interval between receipt by the display of the current frame and the one before, and assume that the next frame will arrive after a similar delay.

Using a Statistical Model of Multiple Previous Frame Time Intervals

Patterns in the frame time history may be used to predict the duration of display of an image frame. In some circumstances a processor may generate inter-frame time intervals that exhibit a heat pattern. For example, a 2-phase beat pattern with the frame intervals that are 8 ms, 13 ms, 8 ms, 13 ms; or a 3-phase beat pattern with frame intervals like this: 8 ms, 12 ms, 15 ms, 8 ms, 12 ms, 15 ms. If this kind of pattern is present, the arrival of the next frame may be predicted using the pattern.

Extracting the Exact Frame Interval by Delaying Frames

In this case, instead of predicting the arrival time of the next frame, the display system waits for the next frame to arrive, before displaying the current one. By doing so, estimation of the duration of the display of the image frame may be avoided.

To allow for the aforementioned waiting time, the display system may store a number of image frames to buffer up new incoming image frames while previous image frames are waiting to be rendered. The incoming image frames may be stored in a FIFO, the depth of which is as follows:

Number of frames stored in FIFO=(Maximum Time Interval Allowed between two Frames Minimum Time Interval Allowed between two Frames.)

Figure 6:
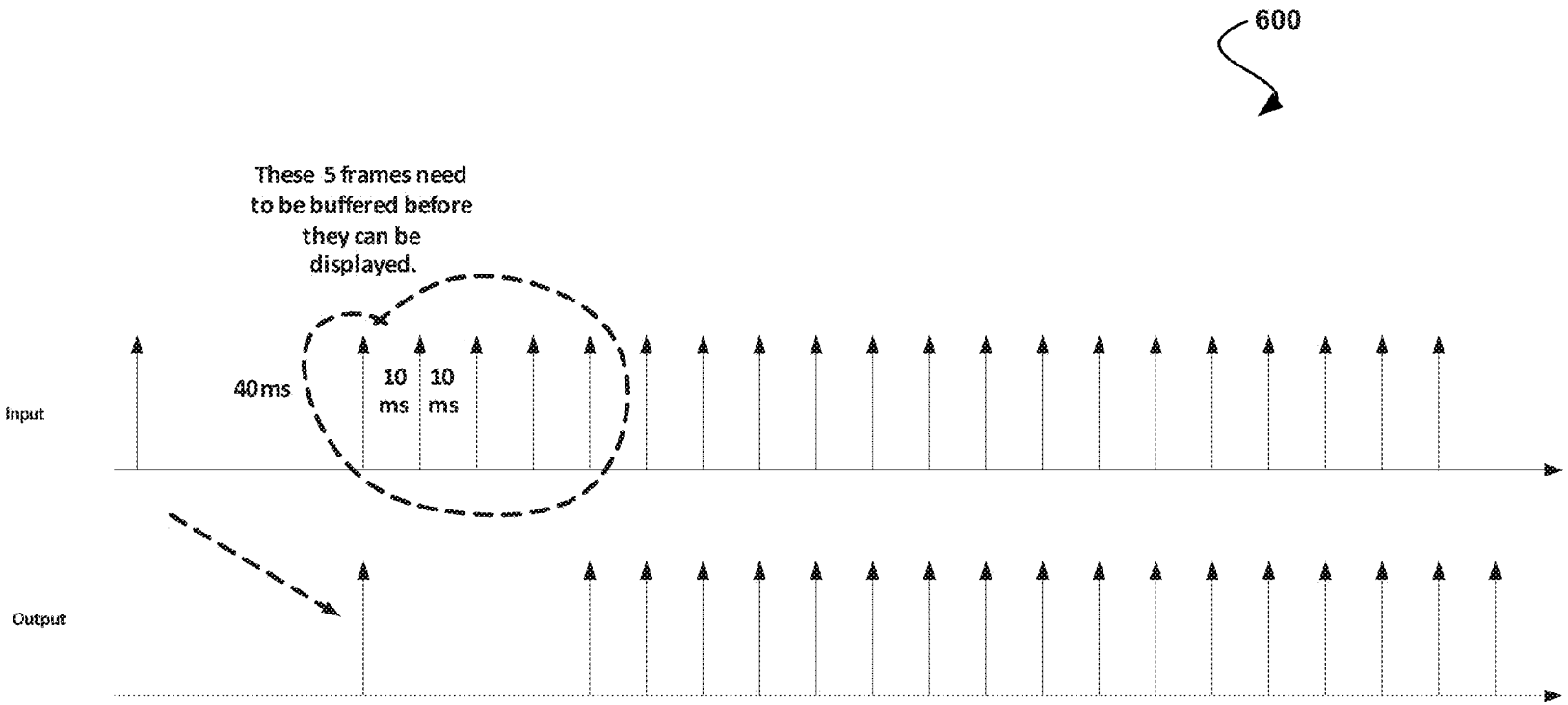
FIG. 6 shows a timing diagram for determining a duration of time during which an image frame is to be displayed by delaying image frames, in accordance with one embodiment.

FIG. 6 shows a timing diagram 600 for determining a duration of time during which an image frame is to be displayed by delaying image frames, in accordance with the presently described embodiment. In the example shown, the maximum time interval between two frames is 40 ms, and the minimum time interface is 8 ms.

For the following frame intervals: 40 ms, 10 ms, 10 ms, 10 ms, 10 ms, 10 ms, 10 ms, etc., it is shown that the image frames that arrive after the delay of 40 ms will need to be buffered before they can be displayed. The display may always have to insert a delay that is the worst case possible if it really wants to enable the backlight correctly at all times. It should be noted that although the frame intervals appear regular in FIG. 6, they can also be irregular.

Using Source Information to Predict the Image Frame Duration

Image frames are typically generated by a processor that runs a long sequence of operations to produce the desired image frame. The processor can have insight into how far along it is in the creating of the next image frame. Similarly the processor can use information about the game/application or about earlier frames to predict when it will complete the next frame.

By correlating this progress information with the state of progress during the production of earlier images, it is possible to better predict when the current image will be completed. If this prediction is fed into the display, it can be used to better control when the backlight needs to be enabled or disabled.

Figure 7:
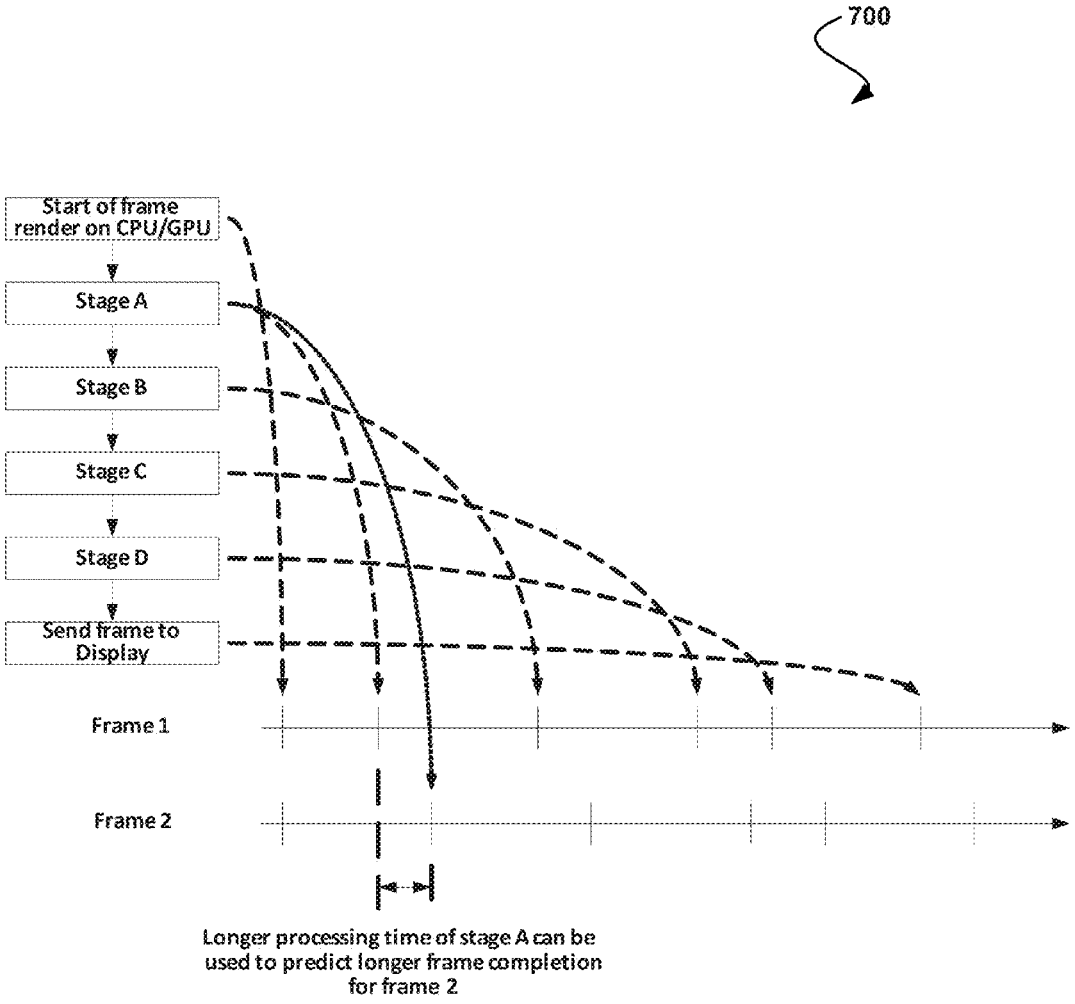
FIG. 7 shows a system for using information from a processor rendering image frames to estimate a duration of time during which an image frame is to be displayed, in accordance with one embodiment.

FIG. 7 shows a system 700 for using information from a processor rendering image frames to estimate a duration of time during which an image frame is to be displayed, in accordance with the present exemplary embodiment. In the example shown, there are four major processing stages performed by the processor to create an image frame but, in general it could be one or more.

When there is significant difference in time to finish stage A for frame 2 compared to previously displayed frame 1, then this may indicate that the overall time to complete the frame 2 will take longer too. This is information that can be sent to the display to determine the estimated duration of the image frame to be displayed. Further, while Stage A can estimate the length of time required to generate the frame, any of the later stages can modify that estimate as more information becomes available.

Soft Transition Between a Variable Refresh Rate Mode of Operation and Low Motion Blur Mode of Operation by Trading Off Backlight Pulse Intensity for Pulse Length The switch between a variable refresh rate mode of operation with a constant backlight and a low motion blur mode of operation may be binary: one moment, the backlight is continuously on (e.g. when the refresh rate is too low to avoid the flicker of a flashing backlight), the other the display logic switches to a mode where the backlight flashes at the shortest possible time that ensures the lowest amount of blur.

In other words, transitioning from operating a hold-type display in a first mode of operation (with variable refresh rate and constant backlight) to operating the hold-type display in the second mode of operation (with low motion blur) may include displaying an image frame in the first mode of operation, and then displaying a next image frame in the second mode of operation with the backlight of the hold-type display being flashed for the duration of time and the level of intensity which in combination produces the desired level of light output by the backlight.

However, it may be desirable to make a softer transition between a variable refresh rate mode of operation with a constant backlight and a low motion blur mode of operation with flashing backlight (and vice versa). One reason might be that a full switch between the two modes of operation causes some visually unpleasant effects. Another reason might be because the electronics of the backlight do not have the ability to change the driving current for the backlight LEDs between the two modes fast enough when switching between the two modes. For example, low motion blur may require a much higher driving current than a variable refresh rate mode of operation with a constant backlight in order to ensure that the light intensity of a short pulse (flash) matches the light intensity of an always on backlight.

Figure 8:
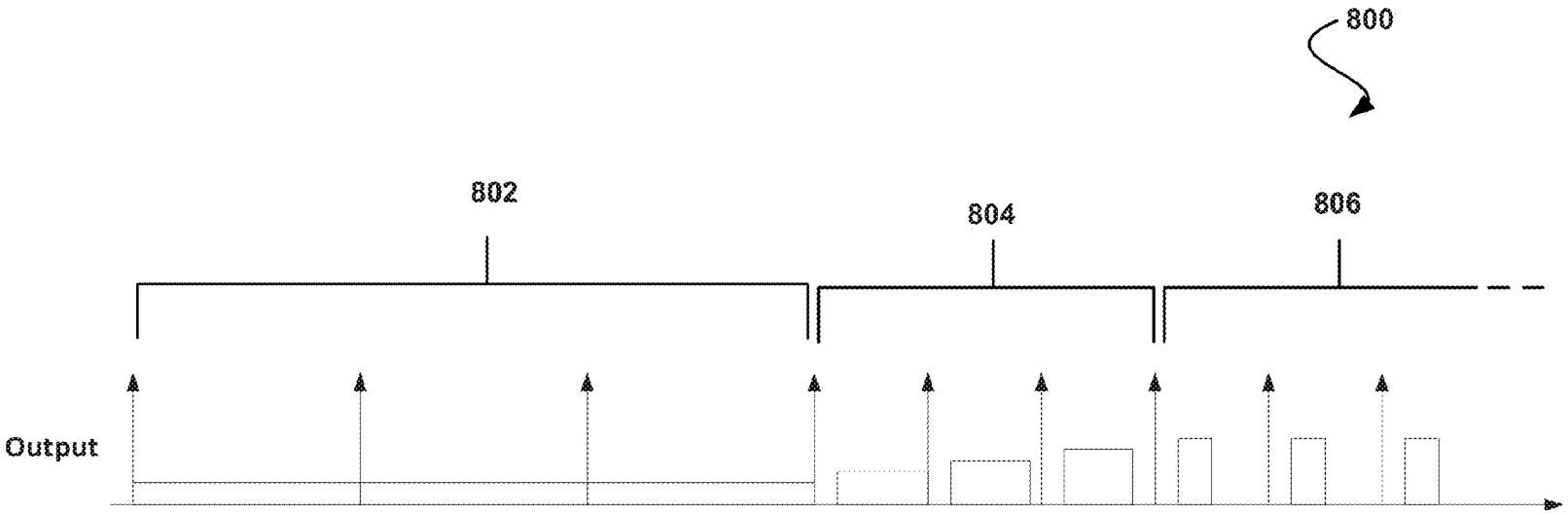
FIG. 8 shows a timing diagram providing a soft transition from operating a display with a variable refresh rate and constant backlight to operating the display with a flashing backlight, in accordance with one embodiment. Further, in response to the determination, the display changes from the second mode of operation back to the first mode of operation.

FIG. 8 shows a timing diagram 800 providing a soft transition from operating a display with a variable refresh rate and constant backlight to operating the display with a flashing backlight, in accordance with one embodiment. As shown in the timing diagram 800, there are three intermediate frames with less aggressive backlight flashing before the backlight reaches the regime with most aggressive backlight intensity and shortest pulse.

In other words, transitioning from operating the hold-type display in the first mode of operation (with variable refresh rate and constant backlight) to operating the hold-type display in the second mode of operation (with low motion blur) may include:

1) displaying one or more image frames in the first mode of operation 802, and then 2) displaying a sequence of next image frames 804 in the second mode of operation with the backlight of the hold-type display being flashed for each of the next image frames with incrementally intermediate levels of light output that are between a level of light output by the backlight during the first mode of operation the desired level of light output for the second mode of operation (such that the average light output in each of the phases stays constant, i.e., the pulses get more intense, but the length goes down proportionately), and further 3) displaying one or more subsequent image frames 806 in the second mode of operation with the backlight of the hold-type display being flashed for the duration of time and the level of intensity which in combination produces the desired level of light output for the second mode of operation.

Using Hysteresis in Transitions Between Modes of Operation

In some cases, a regime is possible where predefined conditions alternate between being met/not met, such as when the refresh rate alternates between a refresh rate that is high enough to allow low motion blur (e.g. one that wouldn't cause visible flicker) and a refresh rate that is too low to allow low motion blur. Without further precautions, this may result in the display switching continuously between display modes. Some amount of temporal hysteresis may be introduced which may enable the transition to the low motion blur mode of operation only if the predefined condition has been met (and continues to be met) for a certain amount of time.

Intra-Frame Backlight Intensity and Duration Modulation Based on Newly Available Information about Next Frame Arrival In the aforementioned examples, the display decides on how to control the backlight duration and intensity once for a new frame, based on the prediction about the duration of time for which the image frame is to be displayed, and once decided does not change these parameters.

Figure 9:
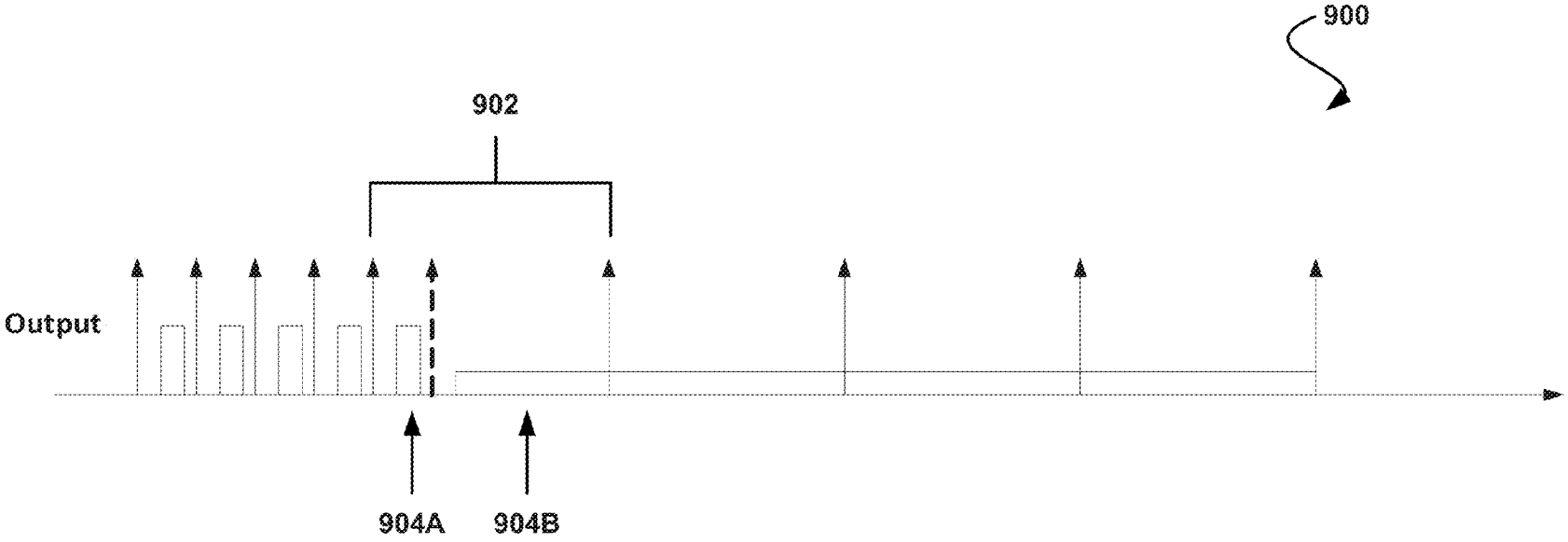
FIG. 9 shows a timing diagram for error compensation when operating a display with a variable refresh rate and flashing backlight, in accordance with one embodiment.

As an option, if the display logic receives more information about the arrival of the next frame while it is controlling the backlight for the current frame, it may decide to change the backlight control parameters instantly to achieve a better visual effect based on the new information. FIG. 9 shows a timing diagram 900 for error compensation when operating a display with a variable refresh rate and flashing backlight, in accordance with one embodiment.

As shown, there is a sudden frame rate shift at 902. The display was not able to predict this sudden change and as a result, it still flashed the backlight in low motion mode even though the next frame was about to arrive much later. If the backlight parameters can be controlled while the current frame is being displayed, it is possible to take corrective action before the next frame arrives, reducing the chance of visual disruption in the process. In the case shown, when a new frame was expected at the location of the dashed arrow, but didn't arrive, the display logic decided to disable the low motion blur mode and switch to the variable refresh rate with constant backlight mode immediately, and thus avoided a temporary drop of average light intensity.

Thus, when displaying an image frame while operating the hold-type display in the second mode of operation (with low motion blur) such that the backlight is flashed to achieve the desired level of light as determined based on the estimated duration of time during which the image frame is to be displayed, the following may be allowed:

1) receipt of information from a processor rendering a next image frame to be displayed by the hold-type display, the information indicating an error in the estimated duration of time during which the image frame is to be displayed, and 2) control of the backlight to correct for the indicated error.

In one example, when the error is that the duration of time during which the image frame is to be displayed is longer than the estimated duration of time the following may occur:

1) determining the duration of time and the level of intensity which in combination produces the desired level of light output by the backlight for the image frame as a function of the longer duration of time for the image frame indicated by the information received from the processor, and 2) correcting for the error by re-activating the backlight after the flashing of the backlight for the image frame in order to achieve the desired level of light output that is the function of the longer duration of time.

Longer Term Frame Time Interval Statistics to Determine Low Motion Bit Suitability The visual quality of low motion blur in a variable refresh rate display may be highly dependent on the ability to accurately predict or identify the arrival time of the next frame, and thus the duration of display of the current image frame. To prevent a bad visual experience, the display logic may prevent going into low motion blur mode when such accurate predication cannot be made. This can be achieved by keeping a history of the frame time intervals and maintaining statistics that show whether or not there is, in general, a high chance of predicting the arrival time of the next frame.

One such statistic could be a percentage difference between the last frame interval and the one before, and a histogram that tabulates these differences in buckets. When the amount of histogram entries with differences above a certain threshold (low correlation) exceeds a certain value, the input source would be determined to be not suitable for low motion blur mode.

Figure 10A:
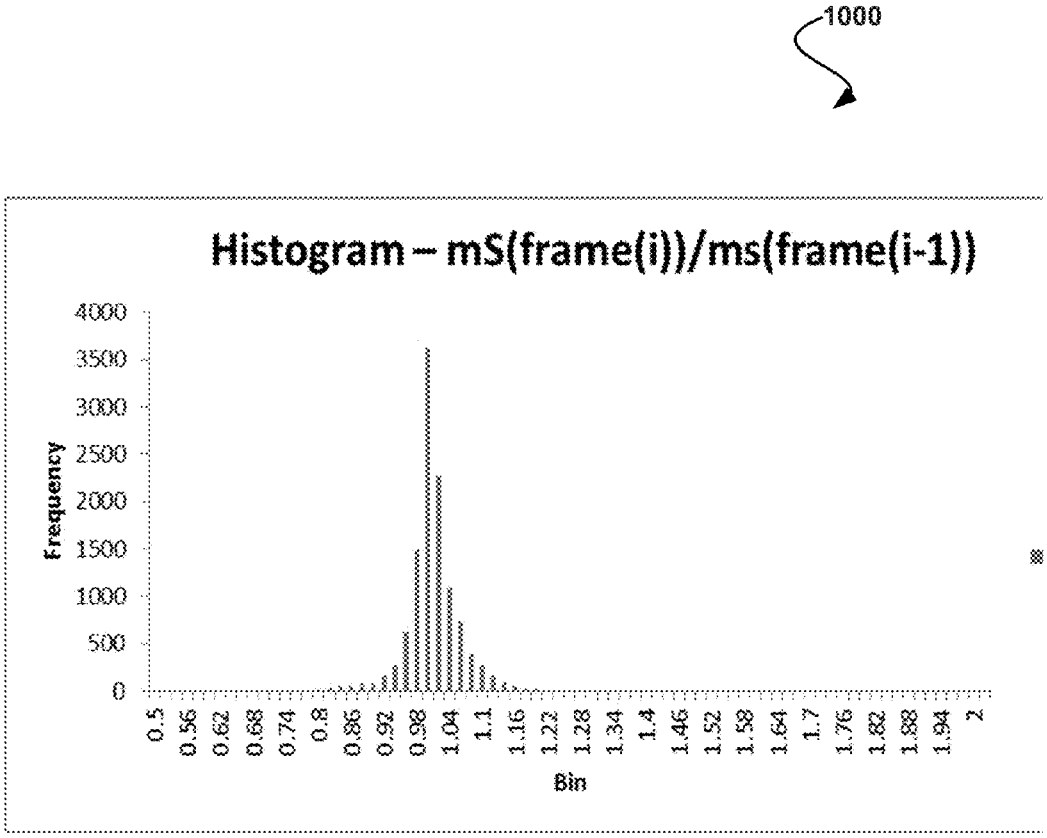
FIG. 10A-B show refresh rate statistics that may be used as a condition for transitioning from operating a display with a variable refresh rate and constant backlight to operating the display with a flashing backlight, in accordance with one embodiment.
Figure 10B:
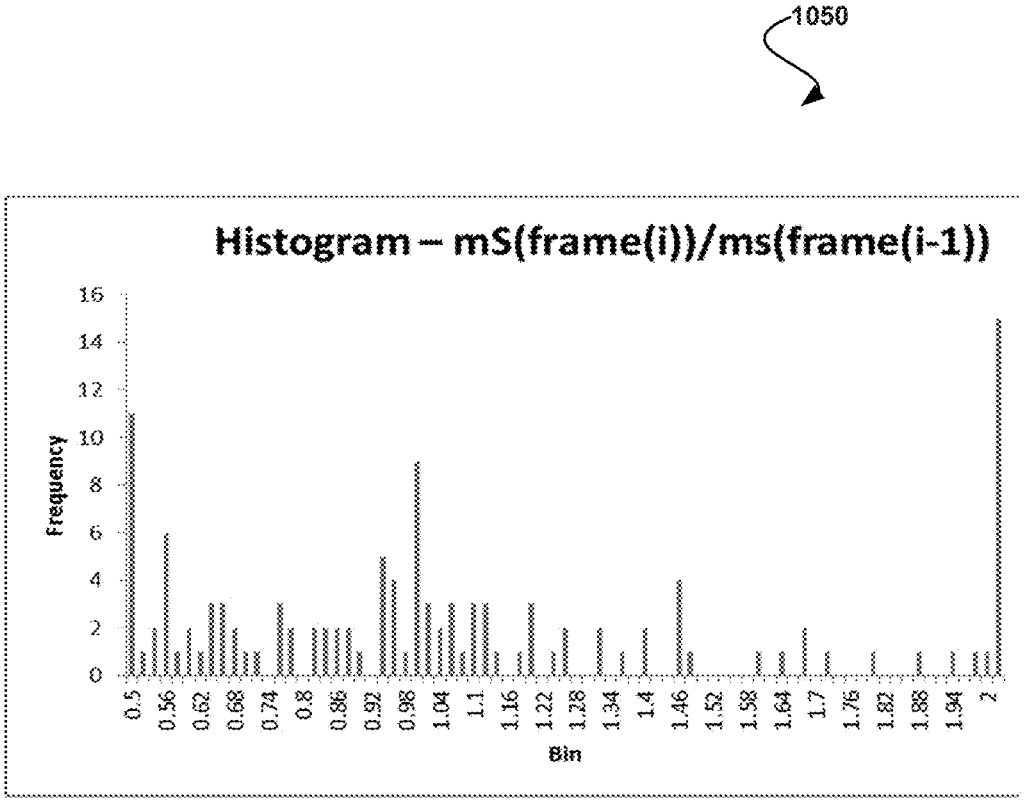

FIG. 10A shows refresh rate statistics for an application such as a game, 1000 that may be used as a condition for transitioning from operating a display with a variable refresh rate and constant backlight to operating the display with a flashing backlight, namely where the refresh rate statistics indicate a predictable input source that is suitable for low motion blur mode. FIG. 10B shows refresh rate statistics 1050 that may be used as a condition for not transitioning from operating a display with a variable refresh rate and constant backlight to operating the display with a flashing backlight, namely where the refresh rate statistics indicate an unpredictable input source that is not suitable for low motion blur mode.

It should be noted that the above described statistical analysis could be done either on the display itself, or on a processor that sends the results to the display.

Signaling Low Motion Blur Suitability by Means of a White List or Black List

Instead of calculating the suitability of a certain input source in real time, a different way to disable low motion blur mode for content that has too erratic of frame times is to have the image source (e.g. processor) inform the display that the current content is not suitable.

A source that creates the content itself, such as the processor, can often know up front whether or not this is the case. One way for the source to know this is by maintaining a list with applications (from which the images originate) that are known to be suitable or not suitable for low motion blur.

When such an application is launched on the processor, the processor can inform the display about low motion blur suitability. It could do so through a side band signal to the display such as the auxiliary data channel of a DisplayPort or the DDC/CI interface of a DVI HDMI interface, or it could do this through an in-band signal such a special packet on the video data interface.

Overdrive Interpolation Stage to Determine Overdrive Table for Chosen Frequency

A display may use overdrive to achieve a desired pixel value at a particular time. For example, an original value desired for a pixel to be displayed may be modified to ensure that the actual pixel value achieved when the pixel is displayed is the desired pixel value. In variable refresh rate mode, the aggressiveness of the overdrive function varies based on the current refresh rate: when the refresh rate is high, the aggressiveness is high, when the refresh rate is low, the aggressiveness is set to low too.

Variable refresh rate overdrive is typically implemented by having overdrive lookup tables for fixed refresh rates and performing interpolation between the closest two overdrive tables (i.e. for which the refresh rate is higher and lower). Examples of variable refresh rate overdrive is described in U.S. patent application Ser. No. 13/830,847, as well as in U.S. patent application Ser. No. 14/024,550, mentioned above and both of which are incorporated herein by reference in their entirety.

In low motion blur mode, for a fixed refresh rate, the overdrive aggressiveness changes with the position on the screen. For example, pixels that are painted at the top of the screen have more time to reach their desired value than those on the bottom of the screen, so the overdrive aggressiveness increases as one goes down the screen. This technique is called 'vertical dependent overdrive'.

Vertical dependent overdrive is typically implemented by having overdrive lookup tables for certain vertical locations on the screen and performing table interpolation between the two closest tables (i.e. for those vertical locations that are in between those locations for which an exact table is available). Examples of vertical dependent overdrive are described in U.S. patent application Ser. No. 13/828,355, filed Mar. 14, 2013, and entitled "Low Motion Blur Liquid Crystal Display," mentioned above and which is incorporated herein by reference in its entirety.

For variable refresh rate low motion blur mode, both variable refresh rate overdrive and vertical dependent overdrive may be combined to determine a desired pixel value. Thus, for a number of chosen refresh rates, a set of vertical dependent overdrive tables may be determined.

In other words, when displaying an image frame while operating the hold-type display in the second mode of operation (with variable refresh rate and low motion blur), for each pixel of the image frame:

1) a value of the pixel to be displayed may be identified, 2) the value of the pixel may be modified as a function of both: a determined duration of time during which the image frame is to be displayed, and a location of the pixel in the image frame, and 3) the pixel may be displayed using the modified value.

As described above, the determined duration of time during which the image frame is to be displayed may be either an estimated duration of time or an actual duration of time.

Figure 11:
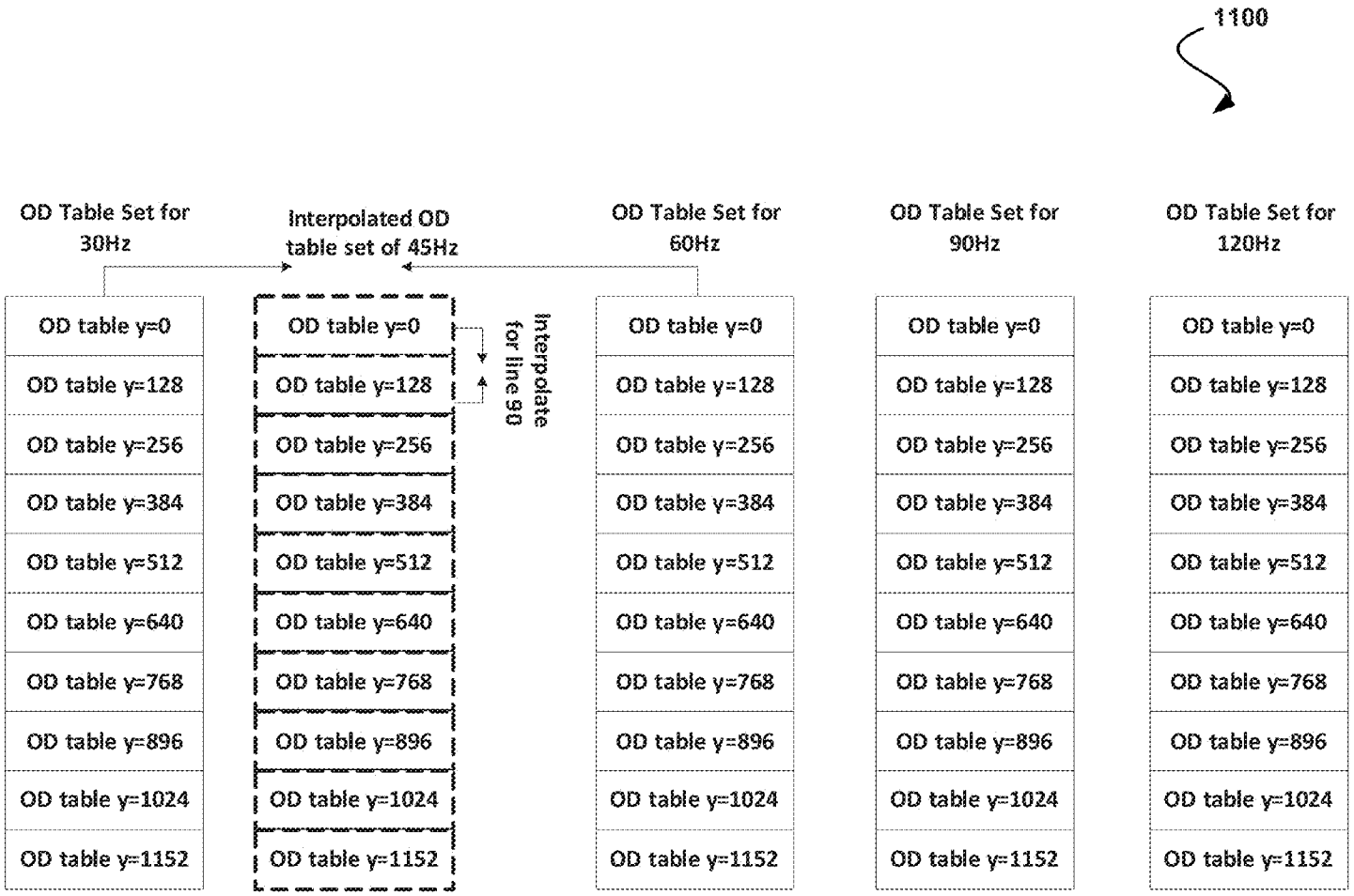
FIG. 11 shows tables for use in modifying a value of a pixel to be displayed by a display with a variable refresh rate and flashing backlight or a constant backlight, in accordance with one embodiment.

FIG. 11 shows tables 1100 for use in modifying a value of a pixel to be displayed by a display with a variable refresh rate and flashing backlight, in accordance with one embodiment. In the embodiment shown, for each of the refresh rates of 30 Hz, 60 Hz, 90 Hz and 120 Hz, a set of 10 overdrive tables is provided, each spaced 128 pixels apart along the vertical axis of the display screen. When a new frame is being rendered at 45 Hz, the display logic will first select two refresh rates that surround the target refresh rate, i.e. 30 Hz and 60 Hz. Then, as it renders along the vertical axis, it selects the corresponding vertical dependent overdrive tables (shown as OD table y=0 and OD table y=128 for both the table specific to 30 Hz and the table specific to 60 Hz), interpolates between them along the time interval axis to determine the interpolated OD table set specific to 45 Hz, and then does a second interpolation along the vertical axis (shown using the OD table y=0 and the OD table y=128 which included in the 45 Hz table set for pixel at line 90).

Measurement of Backlight Intensity to Compensate for Non-Linear Behavior of the Backlight Under Different Current Regimes Due to Process Variations Display backlights can exhibit various non-linear behavior under various process, voltage and temperature conditions. The active/inactive duty cycle also has an influence on the light output under otherwise identical conditions. Since a stable average light output may be crucial to avoid flicker, an additional light measurement sensor may be used to ensure that the average light that is emitted under various conditions is the same. This sensor could be placed outside of the display, or it could be mounted inside the display panel itself, behind the display screen. In an LCD, the sensor may be mounted where the LEDs of the backlight are located. The measurement data of the sensor may be fed back into the control logic and the driving current for the LEDs may be dynamically adjusted to ensure a constant light intensity.

For example, for each displayed image frame an actual level of light output by the backlight may be measured to determine whether the actual level of light output differs from a desired level of light. When it is determined that the actual level of light output differs from the desired level of light, the duration of time and the level of intensity for which the backlight is flashed (for the current and/or future frames) may be adjusted to compensate for the determined difference.

As another option, the sensor may be used for the above described "Intra-frame backlight intensity and duration modulation based on newly available information about next frame arrival." For example, instead of the display logic receiving the additional information about the arrival of the next frame, the sensor may include logic for sensing that the next image frame has not arrived when expected (e.g. per a historical recording and analysis of previous image frame intervals), and may itself decide to activate the backlight to compensate for the a sudden and unexpected frame rate shift.

Impulse-Type Displays with Variable Refresh Rate

Generally, impulse-type displays run above the predefined threshold rate described above. Accordingly, the techniques described herein may also be used to operate the impulse-type displays with a variable refresh rate. For example, the level of light desired to be output may be determined using the aforementioned prediction techniques, and may further be controlled at least by modulating the intensity of the light source of the impulse-type display. In addition, the compensation for process variations described above may also be used with respect to impulse-type displays.

Implementation with Passive Three-Dimensional (3D) Stereo

Optionally, the methods described herein can, in addition, be used with respect to passive 3D stereo, for example where the images are configured for passive 3D stereo (e.g. the odd lines of an image frame show the image intended for one eye of a viewer wearing passive glasses and the even lines of the same image frame show the image intended for the other eye of the viewer wearing the passive glasses).

Exemplary Embodiment

Figure 12A:
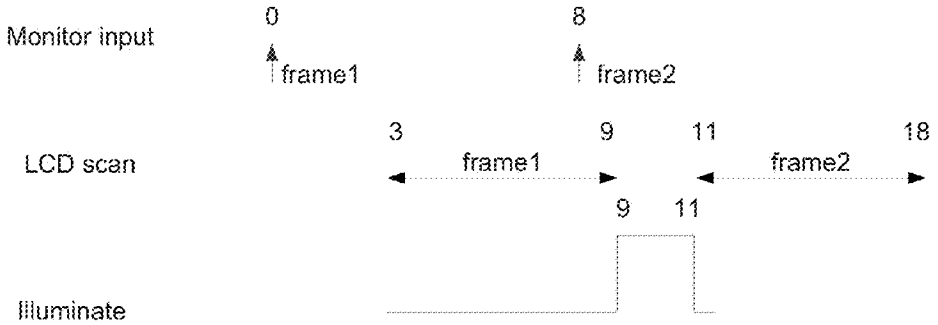
FIGS. 12A-D illustrate exemplary embodiments of modes of operation of a hold-type display, in accordance with one embodiment.

In one embodiment, low motion blur mode may only be used for a display operating at 85 Hz or higher, which is when frames are approximately 12 mSec or less apart. Further, there may be some delay between the first line of a frame input to the display (from the processor), and scanning the first line of that frame to the display panel, due to vertical blanking interval (VBI) up-conversion. This delay is shown in FIG. 12A as 3 mS, which is just for example.

Input frames may arrive at most at a rate of 120 Hz (S mS apart). As shown in FIG. 12A, the panel is scanned in 6 mS (to create the extra VBI to do the backlight flashing). Upon the start of scanning lines of frame(i) to the display, it is predicted how long it will take between frame(i) and frame (i+1). Examples of the prediction techniques are described above.

As described in U.S. patent application Ser. No. 13/828,355, filed Mar. 14, 2013, and entitled "Low Motion Blur Liquid Crystal Display," mentioned above and incorporated herein by reference in its entirety, this prediction is used to decide how much overdrive to use (i.e. the modified value for the pixel).

To absolutely avoid flicker due to incorrect illumination, each scanned frame is illuminated with the same light energy per time average. This is accomplished by either illuminating the frame 100% of the time with strength (intensity) 0.25, or 25% of the time with strength 1. When the prediction of when frame(i+1) is to start after frame(i) is longer than 12 mS, low motion blur should not be used, since it will cause flicker visible to the user. So in that case 100% backlight may be used, at strength 0.25 and it does not matter whether the next frame comes at the expected time. Whatever time the next frame does arrive, since it was not pulsing, it is being illuminated with the correct light energy per time average (see FIG. 12D). As an option, the decision whether or not to use low motion blur depending on the predicted duration less than/more than 12 mS can use temporal hysteresis, as described above, to avoid frequent transitions into and out of low motion blur mode when render time is around 12 mS.

When the prediction is 12 mS or less, the 25% backlight at strength 1 is used. However, the prediction will not be exactly right. FIG. 12A shows what happens when frame (i+1) arrives 8 mS after frame(i). At time t=8, it is known that a new frame came in t=8. So it is known that there is a total illumination time of 0.25*8 mS=2 mS. This illumination is performed at time 9 to 11, right after the panel has been scanned.

Figure 12B:
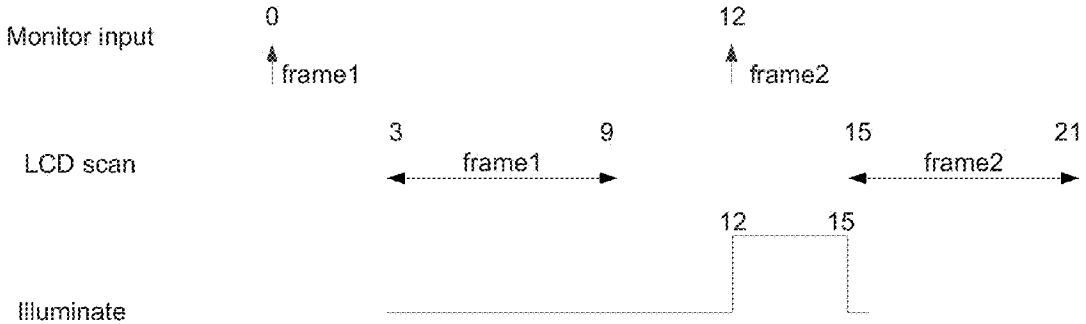

FIG. 12B shows what happens when frame(i+1) arrives 12 mS after frame(i). At time t=12 the new frame is illuminated, for 3 mS. For any frame that arrives between 8 mS and 12 mS after frame 1, it is known what to do, and it is known in time, such that the backlight is flashed with 0.25*the frame(i+1)−frame(i) start time.

Figure 12C:
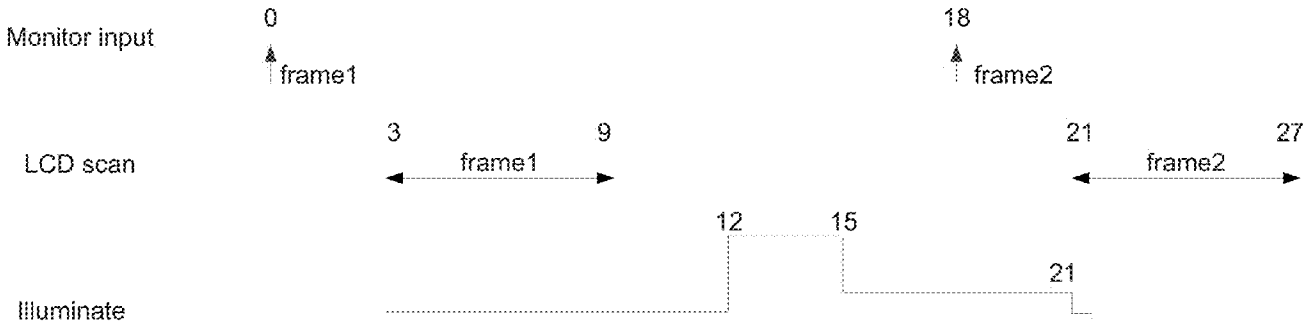
Figure 12D:
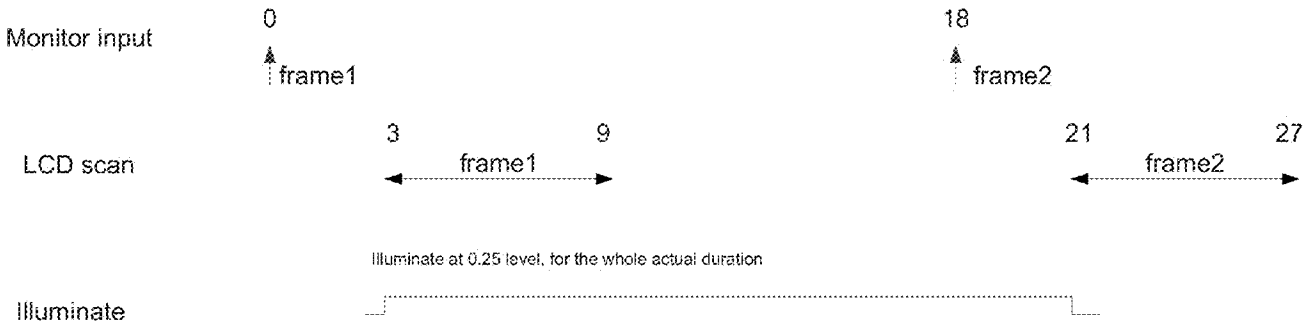

FIG. 12C shows a situation when the actual time of frame(i+1) starts later than 12 mS after frame(i). After completing the 3 mS flash (25% of 12 mS), strength 0.25 mode is entered for as long as the prediction was off. So the total per time illumination of the first 12 mS was correct, and no matter how much longer the incoming frame takes, the illumination of that part is correct. There is no illumination error, but there may be some blurring.

The above examples show how flicker due to incorrect illumination can be avoided. The backlight may always be flashed only with 25% whenever low motion blur can be used. Blurring may only be caused if the refresh rate drops below 12 mS (85 Hz).

It should be noted that the above values are those that may used in practice on LCD panels (rounded off). But of course other values may be selected. For example, if a strong enough backlight is available, a 10% illumination strategy may be used, with associated intensity level, etc. If the panel supports scan faster than 6 mS, the scan can be started later, to create more 'settling delay' between end of scan and start of illuminating pulse. Max input frequency for variable refresh rate with low motion blur mode may be 120 Hz, because the panel may not be able to scan faster than 6 mS, and 2 mS is needed for the VBI.

Figure 13:
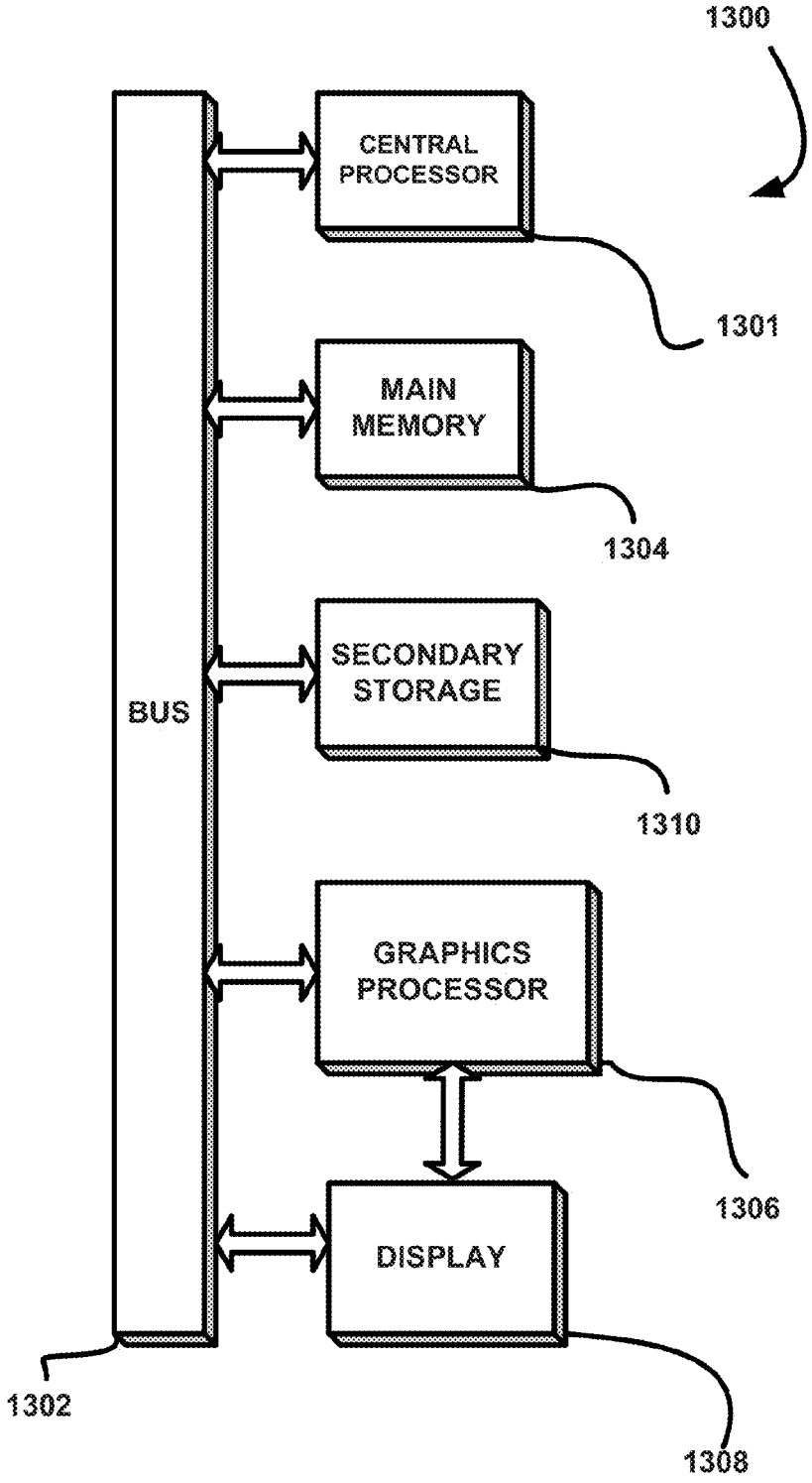
FIG. 13 illustrates an exemplary system in which the various architecture and/or functionality of the various previous embodiments may be implemented.

FIG. 13 illustrates an exemplary system 1300 in which the various architecture and/or functionality of the various previous embodiments may be implemented. As shown, a system 1300 is provided including at least one host processor 1301 which is connected to a communication bus 1302. The system 1300 also includes a min memory 1304. Control logic (software) and data are stored in the main memory 1304 which may take the form of random access memory (RAM).

The system 1300 also includes a graphics processor 1306 and a display 1308, i.e. a computer monitor. In one embodiment, the graphics processor 1306 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 1300 may also include a secondary storage 1310. The secondary storage 1310 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 1304 and/or the secondary storage 1310. Such computer programs, when executed, enable the system 1300 to perform various functions. Memory 1304, storage 1310, volatile or non-volatile storage, and/or any other type of storage are possible examples of non-transitory computer-readable media.

In one embodiment, the architecture and/or functionality of the various previous figures may be implemented in the context of the host processor 1301, graphics processor 1306, an integrated circuit (not shown) that is capable of at least a portion of the capabilities of both the host processor 1301 and the graphics processor 1306, a chipset (i.e. a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 1300 may take the form of a desktop computer, lap-top computer, and/or any other type of logic. Still yet, the system 1300 may take the form of various other devices including, but not limited to a personal digital assistant (PDA) device, a mobile phone device, a television, etc.

Further, while not shown, the system 1300 may be coupled to a network [e.g. a telecommunications network, local area network (LAN), wireless network, wide area network (WAN) such as the Internet, peer-to-peer network, cable network, etc.) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

operating a hold-type display in a first mode of operation, wherein the hold-type display is dynamically refreshed such that the hold-type display handles updates to image frames at unpredictable times, and wherein, in the first mode of operation, a backlight of the hold-type display is activated for the entirety of a duration of time each of the image frames is displayed;

determining that at least one first predefined condition has been met;

in response to the determination that the at least one first predefined condition has been met, operating the hold-type display in a second mode of operation wherein the hold-type display is dynamically refreshed, and wherein, in the second mode of operation, the backlight of the hold-type display is flashed during the duration of time each of the image frames is displayed, wherein a time the backlight is activated during the duration of time each of the image frames is displayed is less than the entirety of the duration of time each of the image frames is displayed;

determining that at least one second predefined condition has been met; and in response to the determination that the at least one second predefined condition has been met, returning operation of the hold-type display from the second mode of operation to the first mode of operation, wherein the time the backlight is activated for a particular image frame in the second mode of operation is determined as a function of an estimated duration of time that the particular image frame will be displayed, and wherein the estimated duration of time for a particular image frame is determined based on a duration of time a preceding image frame is displayed in combination with information received from a processor rendering the particular image frame, the information indicating for each rendering operation performed by the processor, any difference between a time taken to perform the operation when rendering the particular image frame and a time taken to perform the operation when rendering the preceding image frame.

2. The method of claim 1, wherein the at least one predefined condition includes a predefined refresh rate of the hold-type display, such that determining that the at least one predefined condition has been met is based on a determination that the hold-type display is operating at or above the predefined refresh rate.

3. The method of claim 2, wherein temporal hysteresis is utilized with respect to the predefined threshold rate for determining whether the at least one predefined condition has been met, including:

determining that the at least one predefined condition has been met when the hold-type display is operating at or above the predefined refresh rate for a preconfigured amount of time.

4. The method of claim 1, wherein the at least one predefined condition includes a determination that fewer than a threshold number of image frame pairs previously displayed in sequence differed in duration by less than a threshold amount.

5. The method of claim 1, wherein the at least one predefined condition includes a determination that an application generating the image frames is either:

included in a whitelist of applications predetermined to be suitable with operation of the hold-type display in the second mode of operation, or not included in a blacklist of applications predetermined to not be suitable with operation of the hold-type display in the second mode of operation.

6. The method of claim 1, wherein a desired average level of light is constant across a plurality of image frames displayed during operation of the hold-type display in the second mode of operation.

7. The method of claim 1, wherein transitioning from operating the hold-type display in the first mode of operation to operating the hold-type display in the second mode of operation includes:

displaying an image frame in the first mode of operation, and then displaying a next image frame in the second mode of operation with the backlight of the hold-type display being flashed at a level of intensity that, in combination with the time the backlight is activated, produces a desired level of light output by the backlight.

8. The method of claim 1, wherein transitioning from operating the hold-type display in the first mode of operation to operating the hold-type display in the second mode of operation includes:

displaying an image frame in the first mode of operation, and then displaying a sequence of next image frames in the second mode of operation with the backlight of the hold-type display being flashed for each of the next image frames at incrementally intermediate levels of intensity that are between a level of intensity for the backlight during the first mode of operation that, in combination with the time the backlight is activated, produces a desired level of light output for the second mode of operation, and further displaying a subsequent image frame in the second mode of operation with the backlight of the hold-type display being flashed at a level of intensity that, in combination with the time the backlight is activated, produces the desired level of light output for the second mode of operation.

9. The method of claim 1, wherein displaying an image frame while operating the hold-type display in the second mode of operation comprises:

receiving information from the processor rendering a next image frame to be displayed by the hold-type display, the information indicating an error in the estimated duration of time during which the image frame is to be displayed, and controlling of the backlight to correct for the indicated error.

10. The method of claim 9, wherein the error indicates that the duration of time during which the image frame is to be displayed is longer than the estimated duration of time, displaying the image frame while operating the hold-type display in the second mode of operation further comprises:

determining a level of intensity that, in combination with the time the backlight is activated, produces a desired level of light output by the backlight for the image frame as a function of the longer duration of time for the image frame indicated by the information received from the processor, and correcting for the error by re-activating the backlight after the flashing of the backlight for the image frame in order to achieve the desired level of light output that is the function of the longer duration of time.

11. The method of claim 1, wherein displaying an image frame while operating the hold-type display in the second mode of operation, for each pixel of the image frame, comprises:

identifying a value of the pixel to be displayed, modifying the value of the pixel as a function of both: a determined duration of time during which the image frame is to be displayed, and a location of the pixel in the image frame, and displaying the pixel using the modified value.

12. The method of claim 11, wherein the determined duration of time during which the image frame is to be displayed includes either an estimated duration of time or an actual duration of time.

13. The method of claim 1, wherein for each of the image frames an actual level of light output by the backlight is measured to determine whether the actual level of light output differs from a desired level of light output, such that when it is determined that the actual level of light output differs from the desired level of light output, a level of intensity of the backlight for the current and/or future frames is adjusted to compensate for the determined difference.

14. The method of claim 1, wherein the image frames are passive three-dimensional (3D) stereo image frames, such that the hold-type display displays the images for passive 3D stereo viewing.

15. The method of claim 1, wherein the backlight is flashed a predetermined amount of time after the beginning of the display of the image frame by the hold-type display.

* * * * *